US008137787B1

(12) United States Patent
Ohmi et al.

(10) Patent No.: US 8,137,787 B1
(45) Date of Patent: Mar. 20, 2012

(54) METAL MATERIAL HAVING FORMED THEREON CHROMIUM OXIDE PASSIVE FILM AND METHOD FOR PRODUCING THE SAME, AND PARTS CONTACTING WITH FLUID AND SYSTEM FOR SUPPLYING FLUID AND EXHAUSTING GAS

(75) Inventors: Tadahiro Ohmi, Miyagi-ken (JP); Yasuyuki Shirai, Miyagi-ken (JP); Nobukazu Ikeda, Osaka (JP); Eiji Ideta, Osaka (JP); Akihiro Morimoto, Osaka (JP); Tetsutaro Ogushi, Tokyo (JP); Takehisa Konishi, Tokyo (JP)

(73) Assignees: Tadahiro Ohmi, Miyagi-Ken (JP); Fujikin, Inc., Osaka (JP)

( * ) Notice: Subject to any disclaimer, the term of this patent is extended or adjusted under 35 U.S.C. 154(b) by 0 days.

(21) Appl. No.: 09/889,269

(22) PCT Filed: Jan. 13, 2000

(86) PCT No.: PCT/JP00/00133

§ 371 (c)(1),
(2), (4) Date: Mar. 5, 2002

(87) PCT Pub. No.: WO00/42239

PCT Pub. Date: Jul. 20, 2000

(30) Foreign Application Priority Data

Jan. 13, 1999 (JP) ..... 11-007092

(51) Int. Cl.
*B32B 15/04* (2006.01)
*B32B 9/00* (2006.01)
*B32B 19/00* (2006.01)

(52) U.S. Cl. ..... 428/141; 428/457; 428/469; 428/689; 428/702; 428/137

(58) Field of Classification Search ..... 428/131, 428/137, 138, 141, 913, 457, 469, 689, 702; 205/156

See application file for complete search history.

(56) References Cited

U.S. PATENT DOCUMENTS

| | | | | |
|---|---|---|---|---|
| 4,248,676 | A * | 2/1981 | Uchida et al. | 205/156 |
| 4,507,339 | A * | 3/1985 | Carbo et al. | 220/62.12 |
| 5,164,270 | A | 11/1992 | Natesan | |
| 5,298,149 | A | 3/1994 | Kawamura et al. | |
| 5,597,109 | A | 1/1997 | Ohmi et al. | |
| 5,656,099 | A * | 8/1997 | Ohmi | 148/280 |
| 5,686,194 | A | 11/1997 | Shimizu et al. | |
| 6,331,241 | B1 | 12/2001 | Ilgar | |

FOREIGN PATENT DOCUMENTS

| | | |
|---|---|---|
| JP | 7-145498 | 6/1995 |
| JP | 07180088 A | 7/1995 |
| JP | 7-233476 | 9/1995 |
| JP | 7-323374 | 12/1995 |
| KR | 9103037 | 5/1991 |

* cited by examiner

*Primary Examiner* — Catherine A Simone
(74) *Attorney, Agent, or Firm* — Young & Thompson

(57) ABSTRACT

The object of the present invention is to form a chromium-oxide film, excellent in corrosion resistance, without containing an oxide film of other metal onto the metallic material. The chromium-oxide passivation film, excellent in corrosion resistance, without containing the oxide film of other metal can be formed inexpensively and in a short time, and a fluid supplying system for safely supplying fluid with hard corrosivity is able to be provided. One step of forming the passivation film consisting of a chromium oxide layer by giving heat treatment, in an oxidizing atmosphere, after coating chromium on the metallic material having a surface roughness (Ra) not more than 1.5 μm.

11 Claims, 4 Drawing Sheets

METAL MATERIAL HAVING FORMED THEREON CHROMIUM OXIDE PASSIVE FILM AND METHOD FOR PRODUCING THE SAME, AND PARTS CONTACTING WITH FLUID AND SYSTEM FOR SUPPLYING FLUID AND EXHAUSTING GAS

BACKGROUND OF THE INVENTION

1. Field of the Invention

The present invention relates to metallic material on which a chromium-oxide passivation film is formed and a method for manufacturing the same, and a fluid supplying/exhaust system.

2. Description of the Related Art

In semiconductor manufacturing technology, gases with a hard corrosive action such as hydrogen chloride or hydrogen bromide or gases with a hard decomposing action such as silane, diborane, phosphine or the like have been used. Since gases hard in corrosivity easily corrode conventional stainless steel (SUS 316L) to result in metal contamination due to corrosion on semiconductor substrates, a semiconductor with high reliability has been difficult to manufacture.

Moreover, since the gases with the hard decomposing action are decomposed easily due to nickel in catalytic action on the stainless steel, the desired gases are difficult to supply with a desired concentration, semiconductors high in reliability have been difficult to manufacture. In recent years, a technology for forming a chromium-oxide passivation film has been introduced in order to solve the problems described above.

However, development of the metallic material, and surface treatment technology prior to oxidizing treatment or various technologies such as a technology supplying an oxidizing atmosphere such as temperature and a component ratio in oxidizing gases have been required in order to form the chromium-oxide passivation film. Therefore, it has been impossible to inexpensively form the chromium-oxide passivation film onto the optional metallic material and parts.

Moreover, although it has been a prior art technology, coating chromium for improvement of corrosion resistance, it has not been excellent since it is poor in adhesion, moreover, chromium has large internal stress, which causes cracks, so that corrosion is caused at an interface between metallic material and the coat film. Although a crack-free chromium coating technology has been developed in order to solve these cracks, fracture due to distortion during processing may occur since the film thickness is uneven, thereby causing corrosion.

Moreover, there has been problem that although a dual-layer chromium coating technology has been developed in order to solve this fracturing due to distortion, this technology uses different coating processes which results in an increase in cost, so that it is poor in productivity.

Moreover, there has been a technology that heat treatment is performed after metal coating. However, there have been problems in these technologies that vacancies (pin holes) exist on the surface after coating, the coat film may peel off, or the film obtained after heat treatment is a composite-oxide film or may have a property of ceramic, and since the metal material or the substrate layer is contact with corrosive gases when such vacancies exist, corrosion progresses on the interface between the metal of the substance layer and the coat film, and the desired corrosion resistance can not be obtained because of the composite-oxide film. Furthermore, it is poor in workability because it has the property of ceramic.

The object of the invention is to provide a metallic material on which a chromium-oxide passivation film (high in productivity) is formed and a method for manufacturing the same by forming this chromium-oxide passivation film, having excellent corrosion resistance, inexpensively and quickly.

The object of the invention is to provide parts contacting with fluid and a fluid supplying system capable of safely supplying safely fluid hard in corrosivity by forming the chromium-oxide film excellent in corrosion resistance without containing an oxide film of other metal.

SUMMARY OF THE INVENTION

The metallic material according to the invention on which chromium-oxide passivation is formed comprises the passivation film consisting of the chromium oxide obtained by oxidizing the chromium coat on the metallic material of which the surface roughness (Ra) is not more than 1.5 μm.

A method for manufacturing the metallic material according to the invention on which the chromium-oxide passivation is formed comprises a step of forming the passivation film consisting of the chromium oxide by applying heat treatment in an oxidizing atmosphere after coating chromium on the metallic material of which the surface roughness (Ra) of a coated surface is not more than 1.5 μm.

Parts contacting with fluid and a fluid supplying/exhaust system according to the invention are characterized by that these are constituted by the metallic material on which the chromium-oxide passivation film having the passivation film consisting of the chromium oxide obtained by oxidizing the chromium coat are formed on the metallic material of which surface roughness (Ra) is not more than 1.5 μm.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Explanations of Characters

Figure 1:
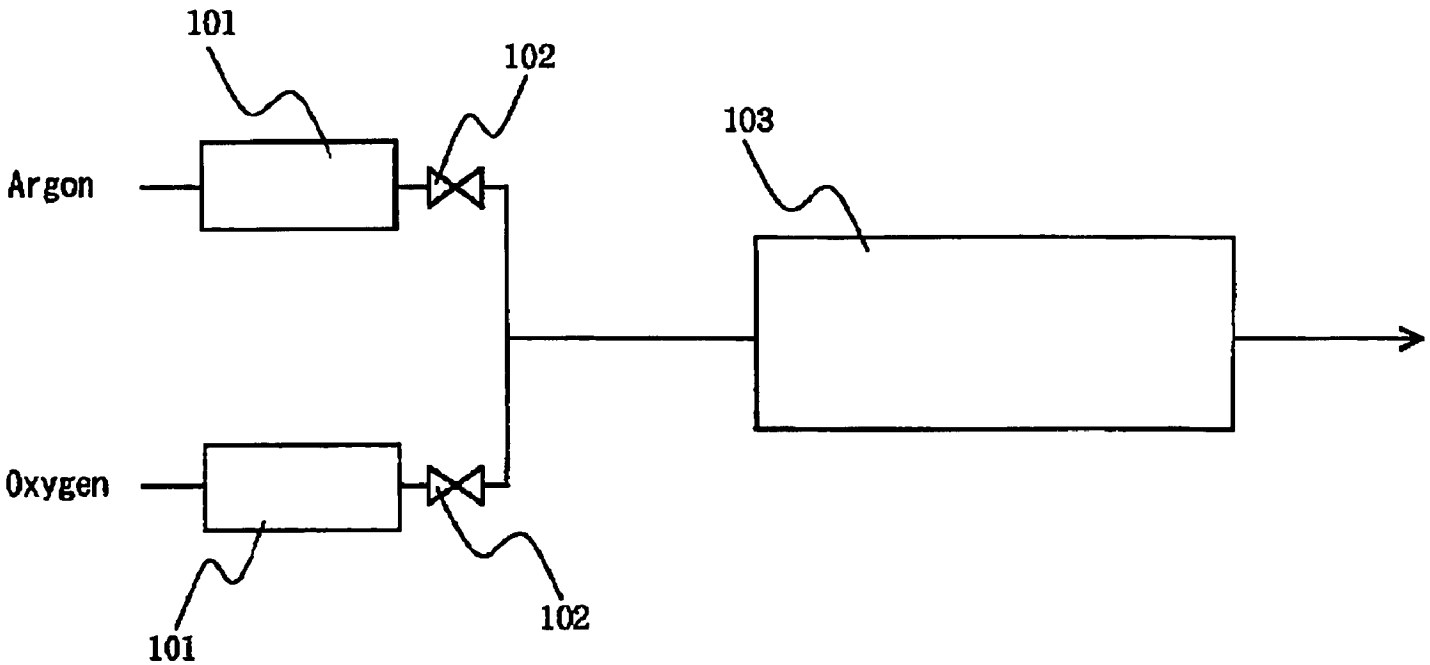
FIG. 1 is a schematic view of a gas supplying system used in a chromium-oxide passivation film according to the invention.

101 flow-rate adjustment device
102 fluid control valve
103 reaction chamber

BEST MODE FOR CARRYING OUT THE INVENTION

This invention comprises a step of forming a passivation film consisting of chromium oxide excellent in corrosion resistance on an optional metallic material by giving heat treatment in an oxidizing atmosphere on a surface obtained by coating chromium onto the metallic material (for example, copper material) of which surface roughness (Ra) is not more than 1.5 μm.

In the invention, a contact ability of an interface between the metallic material and a coat film is improved by coating chromium onto the metallic material of which the surface roughness (Ra) is not more than 1.5 μm, in addition to strengthen a coupling force of the interface by applying heat treatment solves the poorness of the conventional adhesion, and in addition, the chromium-oxide passivation film excellent in corrosion resistance can be formed by applying oxidizing treatment.

This invention comprises the step of forming the passivation film consisting of the sealed chromium oxide, excellent in corrosion resistance, by applying heat treatment in the oxidizing gas atmosphere on the surface of the metallic material on which chromium is coated. According to the invention, the problem of interface corrosion caused due to the presence of vacancies (pin holes) can be solved, in addition, the chromium-oxide passivation film, excellent in corrosion resistance, can be formed by applying oxidizing treatment.

In this invention, definition of the metallic material, definition of the shape of the parts and precise control of the oxidizing atmosphere are not required, and it becomes possible to form the chromium-oxide passivation film onto the optional metallic material and the parts inexpensively as compared to a chromium-oxide passivation treatment of the prior art. A Definition of the metallic material and the shape of the parts and precise control of the oxidizing atmosphere are not required, whereby improvement in productivity can be realized.

Although there have been problems in the conventional chromium-oxide passivation treatment technology that there is a problem in production cost and productivity is poor, since the concentration of the oxidizing gas is low as 10 ppm to several hundreds ppm, moreover, the range of the concentration also is narrow and so use of the special parts for an oxidizing-gas supplying system and a special diluting technology are required in order to control the concentration precisely and monitor for control of the concentration also is required in treatment temperature. The range of the forming condition for formation of the chromium-oxide passivation film can be set widely according to the present invention, whereby a chromium-oxide passivation treatment inexpensive and high in productivity can be realized.

The chromium-oxide passivation film, excellent in corrosion resistance, becomes possible to be formed on the optional metallic material and the parts inexpensively and in a short time according to the invention, the fluid supplying system capable of supplying fluid with the hard corrosive action can safely be constructed.

EMBODIMENTS

Although a forming technology of a chromium-oxide passivation film as well as the parts contacting with fluid a fluid supplying/exhaust system according to the invention will be described with reference to the drawings as described below, the invention should not be limited to these embodiments.

Although a chromium-coat film used for this experiment is deposited by a planting method, in addition thereto, deposition may be performed by coating technologies such as an ion-plating method, HIP method, a sputtering method. Deposition may be performed by a two-step forming method which is designed to be formed by the sputtering method initially and then to be formed by the plating method thereon.

Moreover, baking is preferably performed once at a low temperature of 100° C. to 200° C. in a high-purity inert gas atmosphere (the concentration of moisture is not more than 10 ppm) and then heat treatment is performed, when forming the chromium-coat film by a wet-type plating method.

Moreover, an annealing processing is preferably performed after heat treatment.

Moreover, austenite system stainless steel (SUS316L) was used for the metallic material to be oxidized.

Embodiment 1

FIG. 1 is a schematic view of a gas supplying system performing treatment for the chromium-oxide passivation film according to the invention. Argon is introduced as an inert gas and oxygen as an oxidizing gas for dilution in the gas supplying system. The chromium-oxide passivation film was formed using this gas supplying system.

In the embodiment, an influence of the surface roughness (Ra) of the metallic material to be oxidized was searched by corrosion test with chlorine gas. Oxidizing conditions are 500° C., 30 min, oxygen of 50% (diluted by argon).

Figure 2:
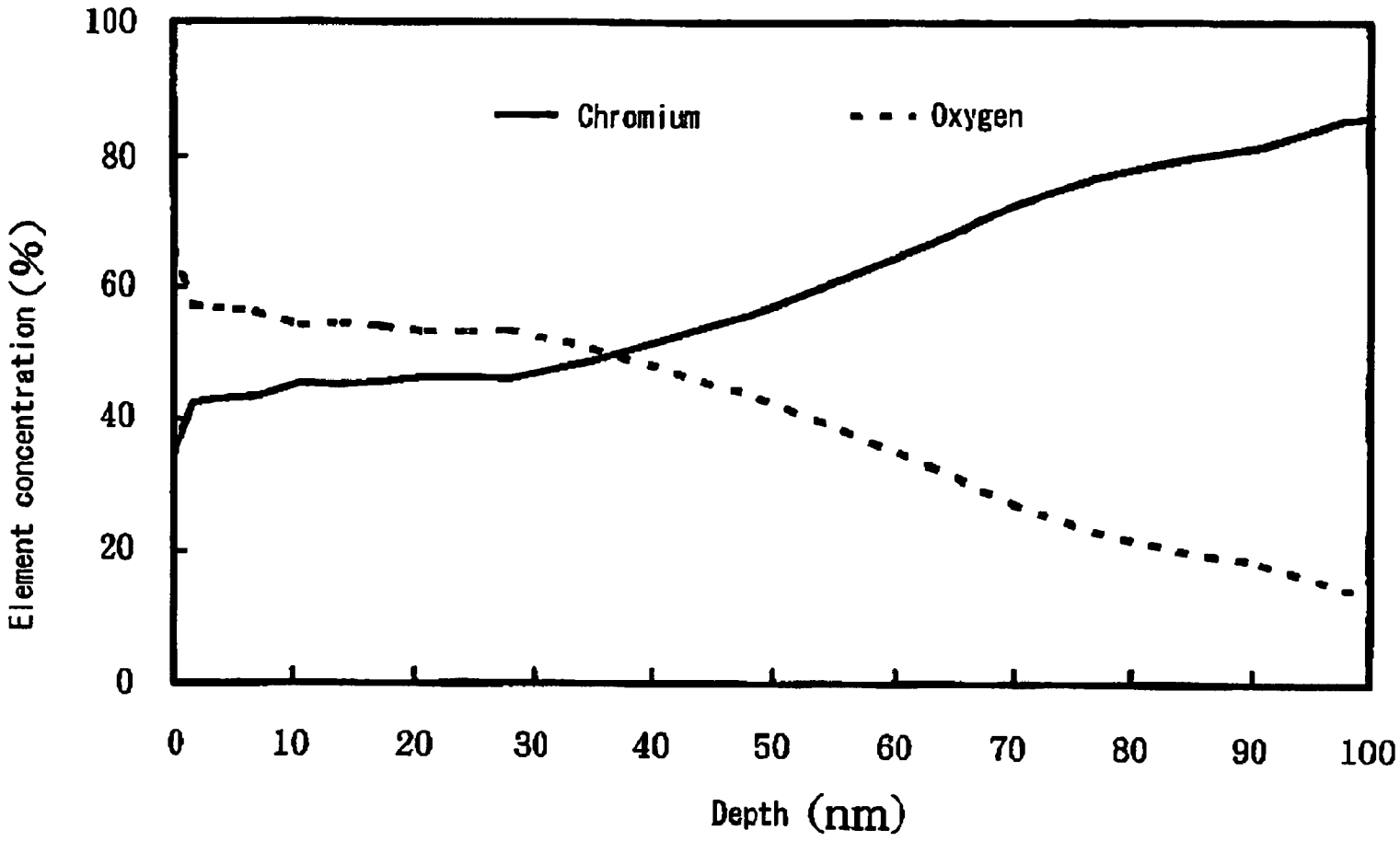
FIG. 2 is a view showing a result of evaluating chromium-oxide passivation film after oxidizing treatment by photoelectron spectroscopy.

FIG. 2 shows a result measured by evaluating chromium-oxide passivation film by a ESCA-100, made by Shimazu Seisakusyo, after oxidizing treatment.

From the results, it was verified that the chromium-oxide passivation film of substantially 100% has been formed, which is approximately 30 nm from the outermost surface.

The corrosion test is performed under the condition of sealing chlorine gas of 100% under not more than 5 $Kgf/cm^2$ at 100° C. for 24 Hr through an accelerated test. Surface observation was performed by a scanning electron microscope JSM-6401F, made by Nippon Densi Kabusikikaisya, after oxidizing treatment.

Figure 3:
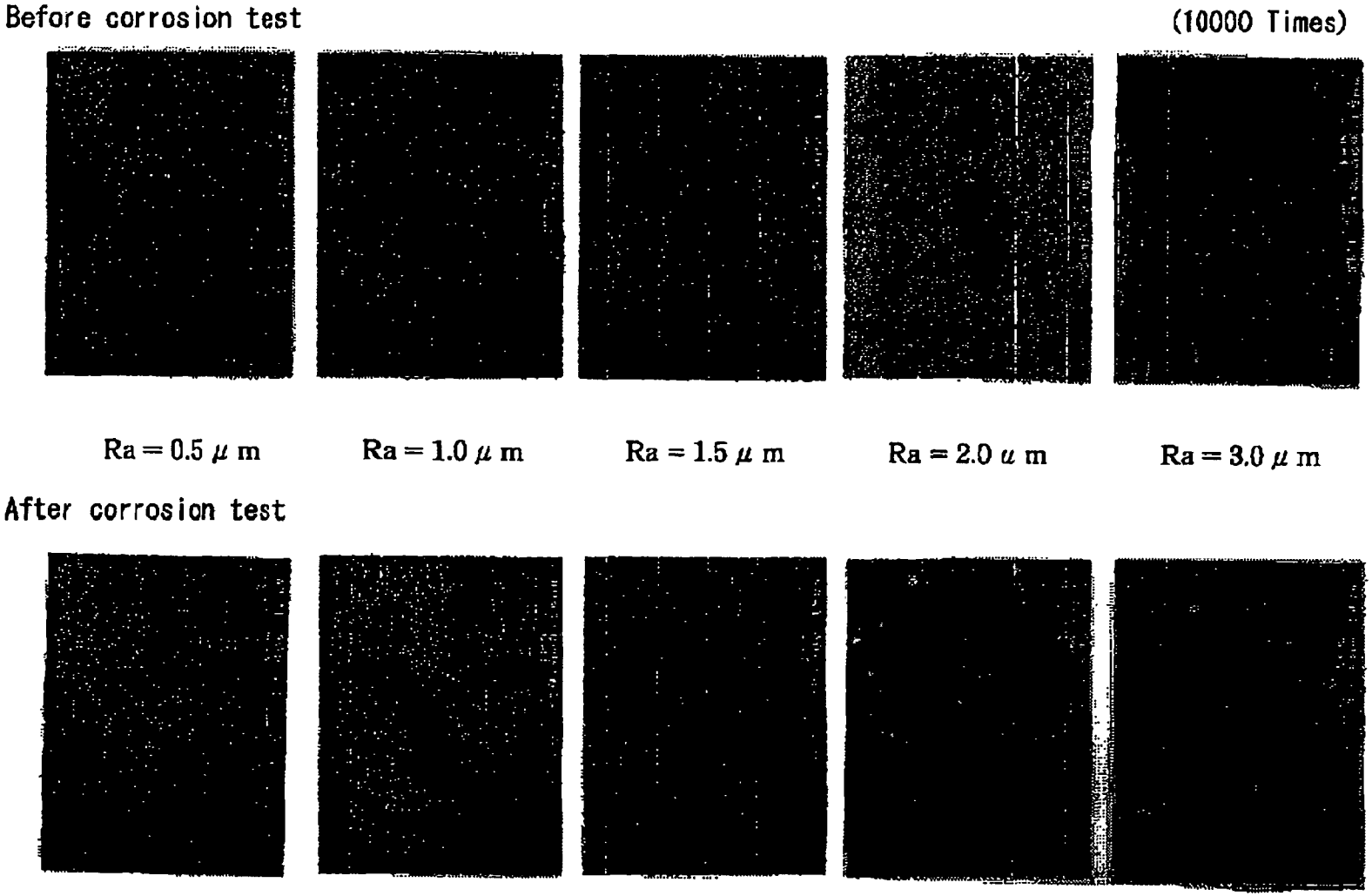
FIG. 3 is a view showing results of evaluation surface roughness (Ra) dependence of corrosion resistance of the chromium-oxide passivation film according to the invention by SEM observation.

FIG. 3 shows results after the corrosion test. From the results, it was not verified that corrosive products exist in the case of the surface roughness (Ra) of not more than 1.5 μm, whereas the corrosive products have been scattered in the case of not less than 2 μm. It is speculated that adhesion of the interface between the metallic material and the chromium-coat film deteriorates, so that clearance corrosion is caused as the surface roughness (Ra) becomes large.

From the results as described above, it is speculated that the chromium-oxide passivation film having corrosion resistance, which is excellent in adhesion of the interface between the metallic material and the chromium-coat film can be formed when the surface roughness (Ra) of not more than 1.5 μm.

Moreover, the chromium-oxide passivation film further excellent in durability can be formed by allowing to coat a metal on the metallic material to be oxidized in pretreatment for forming the chromium-coat film to improve adhesion onto chromium and to prevent crack and fracture due to distortion.

Moreover, the more close-grained and tight chromium-oxide passivation film can be formed by doping with hydrogen into the oxidizing gas.

Embodiment 2

The accelerated corrosion test of the sample on which oxidizing treatment was given in the same condition as Embodiment 1 and the sample on which oxidizing treatment was not given was performed under the condition of sealing chlorine gas of 100% under not more than 5 Kgf/cm$^2$ at 100° C. for 24 Hr.

Figure 4:
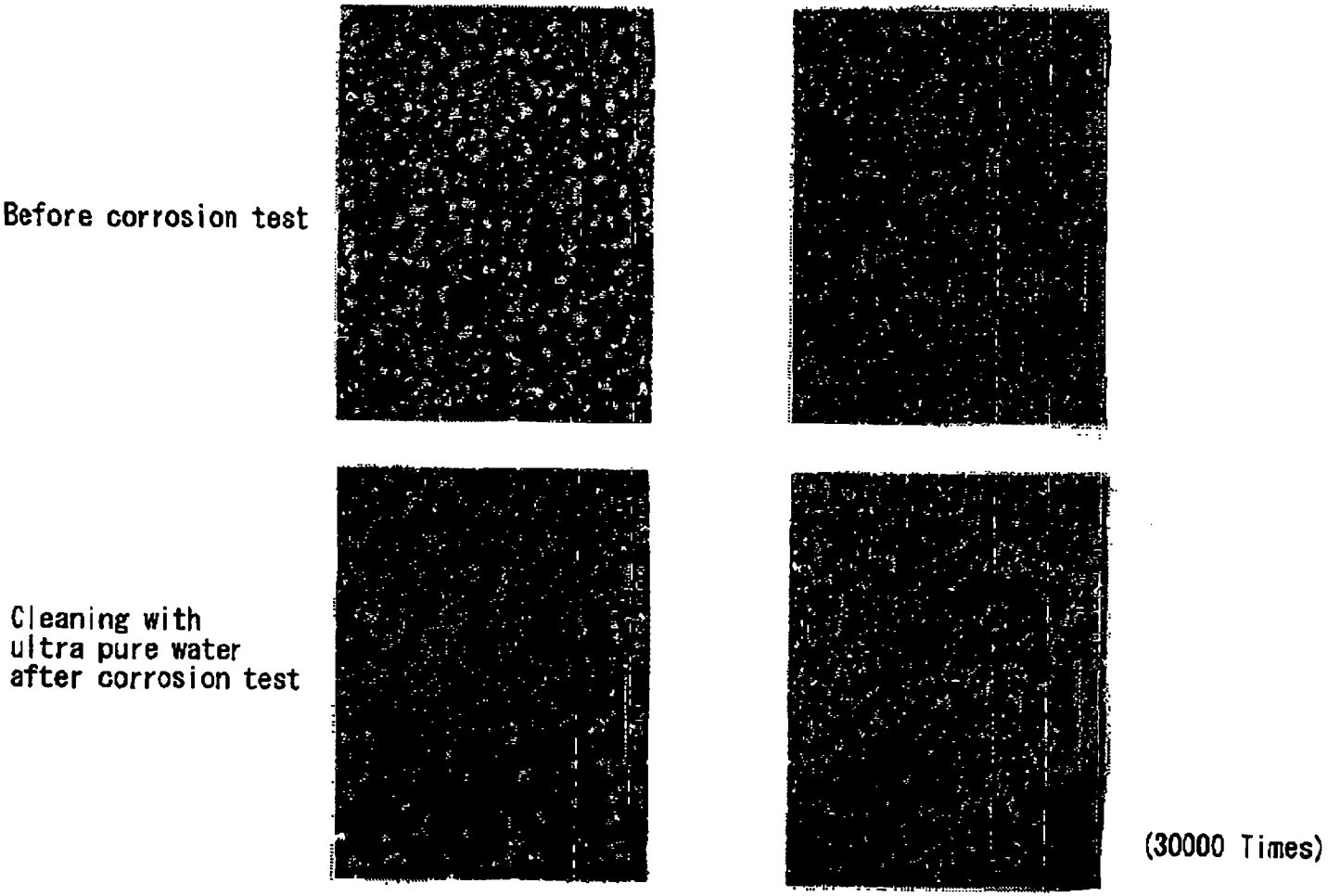
FIG. 4 is a view showing results by SEM observation of the sample after a corrosion test by chlorine gas of the sample by using a method for manufacturing the chromium-oxide passivation film according to the invention and a sample which oxidizing treatment is not given, and sample after cleaning with ultra pure water after the corrosion test.

FIG. 4 shows the results by SEM observation after the corrosion test by JSM-6301F, made by Nippon Densi Kabusikikaisya after oxidizing treatment, as well as the results by SEM observation of the sample after cleaning with ultra pure water after corrosion test.

From the results, it was not verified that corrosion exist for the sample on which oxidizing treatment was given, whereas the corrosive products have been scattered for the sample on which oxidizing treatment was not given.

Moreover, it has been speculated from the results that SEM observation was performed after cleaning the sample after corrosion test with ultra pure water to remove the corrosive products or the like that changes was not observed for the sample on which oxidizing treatment was given, whereas there were the vacancies (the pin holes) of a diameter of approximately 0.1 μm on the site where the corrosive products were removed for the sample on which oxidizing treatment was not given, and this was corrosion contributed to the pin holes existing after plating.

It has been found by these experiments that there are the vacancies on the coat film used for the prior art, and the corrosion caused by the vacancies is progressing, however, the vacancies are filled according to the invention, whereby the chromium-oxide passivation film which is close-grained and excellent in corrosion resistance can be formed on the outermost surface.

Applicability for the Industry

According to the present invention, a passivation film consisting of chromium oxide, excellent in corrosion resistance, form onto metallic material.

According to the present invention, the conventional problem of interface corrosion caused due to the presence of the crack, fracture due to distortion and the vacancies (pin holes) or the like can be solved, in addition, the chromium-oxide passivation film excellent in corrosion resistance can be formed by applying oxidizing treatment.

According to the present invention, definition of the metallic material, definition of the shape of the parts and precise control of the oxidizing atmosphere are not required, and it becomes possible to form the chromium-oxide passivation film onto the optional metallic material and parts inexpensively as compared to a chromium-oxide passivation treatment of the prior art, and definition of the metallic material and the shape of the parts and precise control of the oxidizing atmosphere are not required, whereby improvement in productivity is realized.

According to the invention, the fluid supplying system capable of supplying fluid with hard corrosive action in safety can be constructed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A structure, comprising:

a metallic material having a surface, the metallic surface having a surface roughness (Ra) being not more than 1.5 μm; and a chromium-oxide passivation film providing an outermost surface, said chromium oxide passivation film formed by coating directly onto the metallic material surface a chromium film having a thickness of at least 100 nm, baking the chromium film directly onto the metallic material surface at a temperature of 100° C. to 200° C. and heating the baked chromium film coated directly onto the metallic material surface in an oxidizing atmosphere, wherein, said chromium-oxide passivation film is substantially 100% chromium oxide approximately 30 nm from the outermost surface, chromium of said baked chromium film which is not oxidized remains between said chromium-oxide passivation film and said metallic material, and said chromium remains adhered to the metallic material so that said chromium-oxide passivation film is coupled to said metallic material, and said chromium-oxide passivation film has pin holes, and said pin holes are sealed.

2. The structure according to claim 1, wherein said chromium-oxide passivation film does not substantially include an element of said metallic material.

3. The structure according to claim 2, wherein said metallic material is stainless steel.

4. The structure according to claim 2, wherein said element is Fe or Ni.

5. The structure according to claim 1, wherein said chromium-oxide passivation film is free from cracks.

6. An article, comprising:

a metallic body having a surface, the metallic body surface having a surface roughness (Ra) being not more than 1.5 μm; and a chromium-oxide passivation film providing an outermost surface, the chromium oxide passivation film formed by coating directly onto the metallic material surface a chromium film having a thickness of at least 100 nm, baking the chromium film directly onto the metallic material surface at a temperature of 100° C. to 200° C. and heating the baked chromium film coated directly onto the metallic material surface in an oxidizing atmosphere, wherein, the chromium-oxide passivation film is substantially 100% chromium oxide approximately 30 nm from the outermost surface, and chromium of said baked chromium film which is not oxidized remains between the chromium-oxide passivation film and the metallic material, and the chromium remains adhered to the metallic material so that the chromium-oxide passivation film is coupled to the metallic material.

7. The structure according to claim 6, wherein, said chromium-oxide passivation film has pin holes, and said pin holes are sealed.

8. A structure, comprising:

a metallic body having a surface, the metallic body surface having a surface roughness (Ra) being not more than 1.5 μm; and a chromium-oxide passivation film providing an outermost surface, the chromium oxide passivation film formed by coating directly onto the metallic material surface a chromium film having a thickness of at least 100 nm, baking the chromium film directly onto the metallic material surface at a temperature of 100° C. to 200° C.

and heating the baked chromium film coated directly onto the metallic material surface in an oxidizing atmosphere, wherein, the metallic body surface defines a continuous boundary between the metallic body and the chromium-oxide deposit, the chromium-oxide passivation film is substantially 100% chromium oxide approximately 30 nm from the outermost surface, and chromium of said baked chromium film which is not oxidized remains between the chromium-oxide passivation film and the metallic material, and the chromium remains adhered to the metallic material so that the chromium-oxide passivation film is coupled to the metallic material.

9. The structure according to claim 8, wherein, said chromium-oxide passivation film has pin holes, and said pin holes are sealed.

10. A structure, comprising:

a metallic material having a surface, the metallic surface having a surface roughness (Ra) being not more than 1.5 μm; and a chromium-oxide passivation film formed by coating directly onto the metallic material surface a chromium film having a thickness of at least 100 nm, baking the chromium film directly onto the metallic material surface at a temperature of 100° C. to 200° C. and heating the baked chromium film coated directly onto the metallic material surface in an oxidizing atmosphere, wherein, at least approximately 30 nm from an outermost surface of the chromium-oxide passivation film consisting of substantially 100% chromium-oxide, and chromium of said baked chromium film which is not oxidized remains between the chromium-oxide passivation film and the metallic material, and the chromium remains adhered to the metallic material so that the chromium-oxide passivation film is coupled to the metallic material.

11. The structure according to claim 10, wherein, said chromium-oxide passivation film has pin holes, and said pin holes are sealed.

* * * * *